US005245962A

United States Patent [19]

Routery

[11] Patent Number: 5,245,962

[45] Date of Patent: Sep. 21, 1993

[54] VARIABLE LENGTH CONNECTING ROD FOR INTERNAL COMBUSTION ENGINE

[76] Inventor: Edward E. Routery, 2003 W. Hwy. 66, Gallup, N. Mex. 87301

[21] Appl. No.: 796,474

[22] Filed: Nov. 22, 1991

[51] Int. Cl.[5] ..... F02B 75/32

[52] U.S. Cl. ..... 123/197.3; 74/579 E; 92/187

[58] Field of Search ..... 123/488, 78 E, 197.1, 123/197.3, 197.4; 92/140, 187; 74/40, 44, 579 E, 579 R

[56] References Cited

U.S. PATENT DOCUMENTS

| | | | |
|---|---|---|---|
| 1,420,236 | 6/1922 | Bohman | 74/36 |
| 1,518,334 | 12/1924 | McMaster | 123/197.4 |
| 1,566,486 | 12/1925 | Lee | 74/44 |
| 1,873,908 | 8/1932 | Schinke | 74/44 |
| 2,287,472 | 6/1942 | Eby | 74/44 |
| 3,633,429 | 1/1972 | Olson | 123/197.3 X |
| 3,859,976 | 1/1975 | McWhorter | 123/197.2 |
| 4,085,628 | 4/1978 | McWhorter | 74/579 E |
| 4,463,710 | 8/1984 | McWhorter | 123/48 B |
| 4,467,756 | 8/1984 | McWhorter | 123/197.4 |
| 4,485,768 | 12/1984 | Heniges | 123/197.1 X |
| 4,584,972 | 4/1986 | Jayne et al. | 123/56 C |
| 4,890,588 | 1/1990 | Tillman | 123/78 E |
| 4,974,554 | 12/1990 | Emery | 123/48 B |

FOREIGN PATENT DOCUMENTS

| | | | |
|---|---|---|---|
| 3233314 | 3/1984 | Fed. Rep. of Germany | 123/197.4 |
| 3443701 | 6/1986 | Fed. Rep. of Germany | 123/197.4 |
| 3444233 | 6/1986 | Fed. Rep. of Germany | 123/197.4 |
| 1170326 | 11/1969 | United Kingdom . | |

*Primary Examiner*—Tony M. Argenbright

[57] ABSTRACT

An improved apparatus in an internal combustion engine for causing a piston to remain generally at the top dead center position for a period after the crank has passed top dead center, permitting constant volume combustion of a fuel mixture. A rotatable disc mounted in the upper sleeve end of a connecting rod as an eccentric bore for receiving the wrist pin of a piston. Another eccentric bore in the disc pivotally receives an upper end of a rigid shifter bar. An intermediate portion of the shifter bar is slidably attached to a pin mounted to a lower portion of the piston and a lower portion of the shifter bar is slidably attached to a pin mounted to an intermediate portion of the connecting rod. Thus, angular movement of the connecting rod relative to the pin will cause the shifter bar to rotate the disc imparting an upward motion to the piston to counteract for a time the downward motion of the connecting rod. The position of at least one of the pins may be remotely controlled to be repositioned in proportion to engine speed, or to accommodate alternative fuels.

25 Claims, 2 Drawing Sheets

VARIABLE LENGTH CONNECTING ROD FOR INTERNAL COMBUSTION ENGINE

TECHNICAL FIELD

This invention relates to internal combustion engines, Stirling engines, compressors, pumps and other apparatus having reciprocating pistons. More particularly, the invention relates to a piston connecting rod assembly as disclosed in applicant's Patent application Ser. No. 07/530,754, filed May 30, 1990, now issued as U.S. Pat. No. 5,156,121, dated Oct. 20, 1992.

BACKGROUND OF THE ART

The apparatus disclosed herein is essentially an improvement to applicant's piston connecting rod assembly indicated above, the entirety of which is incorporated herein by reference.

The prior application discloses an apparatus for providing constant volume combustion (CVC) in a two-stroke or four-stroke internal combustion engine. With constant volume combustion, the entire fuel-air mixture burns before the piston makes any substantial movement downward. Without CVC, a portion of the fuel remains unburned until after the piston has moved a distance downward. This remaining portion of the combustion produces less mechanical work and greater exhaust waste heat, worsening efficiency and thermal concerns. In addition, without CVC some fuel may not be completely burned, resulting in higher concentrations of hydrocarbons, carbon monoxide and other undesirable pollutants in the exhaust gas. The emission problems due to the late or incomplete burning of fuel in a non-CVC engine are worsened by the fact that the expansion of the combustion chamber cools the gases contained therein due to the ideal gas law, further slowing the rate of combustion and delaying the combustion of remaining fuel.

Normally, in a conventional piston engine, the piston follows a sinusoidal path as the crank shaft rotates. Thus, the piston is stationary only momentarily when at top dead center (TDC) and bottom dead center (BDC). At full compression, the volume of the combustion chamber above the piston has a substantially constant (and minimum) volume during only a small portion of the angular rotation of the crank. Particularly at high crank rotation rates, this is an insufficient interval to provide complete combustion of the fuel at a constant volume.

In applicant's previous apparatus described in the application noted above, complete constant volume combustion is achieved with a connecting rod that provides added distance between the crank and the piston as the connecting rod is pivoted with respect to the piston. Effectively, the rod pushes the piston away as the crank pivots the rod past TDC, with the pushing away serving to counteract for a time the initial downward motion of the piston. This is achieved by a curvilinear cam groove engaged by a pin on the piston. The net effect provides constant volume combustion by combining a small cyclical vertical motion of the piston relative to the connecting rod with the conventional sinusoidal motion of the piston. As a result, the normal sinusoidal peaks of a conventional engine are flattened and extended to form plateaus; as the piston pauses or dwells without substantial downward motion for a time after the crank passes TDC. During this period, the combustion chamber volume is substantially constant.

These plateaus have a sufficient width, that is, the piston dwell time after TDC is sufficient for the fuel mixture to be entirely burned.

Although the prior art apparatus is effective to provide fuel efficient and clean combustion, particularly with two-stroke engines, it has several functional limitations:

A first limitation of the prior art apparatus is that it is susceptible to wear, particularly at the cam groove. Substantially all of the explosive force of the engine is transmitted to the crank shaft by a pin on the piston that engages the cam groove. The high frictional loading pressures at this interface causes unavoidable wear that eventually degrades performance and decreases life expectancy.

A second limitation of the prior art apparatus is the high manufacturing cost needed to maximize the wearresistance of the components. To get maximum life expectancy from the connecting rod crank, the forged rod must be cut, ground and polished at the cam groove. These multiple manufacturing steps increase manufacturing costs. In addition, the cam groove has a particular irregular shape to provide the proper piston motion profile. This shape requires precise machining to give optimum performance.

A third limitation of the prior art apparatus is that a single connecting rod cam groove design achieves only a single piston motion profile. Therefore, if the engine is to be converted to an alternative fuel, new connecting rods must be designed, manufactured and installed. In addition, for a single fuel, the piston motion profile must be selected to provide an adequate compromise of performance at various crank shaft rotation rates. A profile optimized for slower rotation rates may not achieve constant volume combustion at higher rotation rates because the increased angular velocity of the crank shaft affords less actual time at constant volume for the fuel to burn. A profile optimized for high RPMs may result in excessive dwell that increases internal mechanical stresses and impairs efficiency.

SUMMARY OF THE INVENTION

The primary object of the invention is to provide an improved adjustable length connecting rod for an internal combustion engine, providing prolonged periods of substantially constant combustion chamber volume with long-wearing components.

It is a further object to provide a connecting rod as aforesaid that may be further adjusted to provide extended or reduced periods of constant volume combustion to optimize performance at a wide range of engine speeds.

It is yet another object of the invention to provide a connecting rod as aforesaid that is adjustable to accommodate a variety of fuels having different combustion properties while maintaining the advantages of constant volume combustion. The preferred embodiment of the invention includes several features which act independently and cooperatively to achieve the above objects.

According to the present invention, the objects are achieved by providing a connecting rod between a crank shaft and a piston. The piston end of the crank shaft defines a sleeve in which a disc having an eccentric bore is rotatably mounted. The eccentric bore receives a wrist pin on which the piston pivots. A disc shifter bar is pivotally connected to a second eccentric position on the disc at one end of the bar and slidably connected at the other end to a pin mounted to an intermediate portion of the connecting rod. An intermediate portion of the shifter bar is longitudinally slotted to receive slidably a second stationary pin on the piston. Consequently, angular displacement of the connecting rod with respect to the piston rotates the disc to extend or retract the piston relative to the connecting rod.

The invention may further include a compensator to shift any one of the attachment pins to change the shifting geometry of the mechanism, thereby optimizing the invention for alternate fuels or a range of engine speeds. The invention may further include the remaining components of an engine, including a controller for remotely adjusting the compensator in response to changes in engine speed or fuel composition.

The foregoing and additional features and advantages of the present invention will be more readily apparent from the following detailed description which proceeds with reference to the accompanying drawings.

DETAILED DESCRIPTION OF A PREFERRED EMBODIMENT

Figure 1:
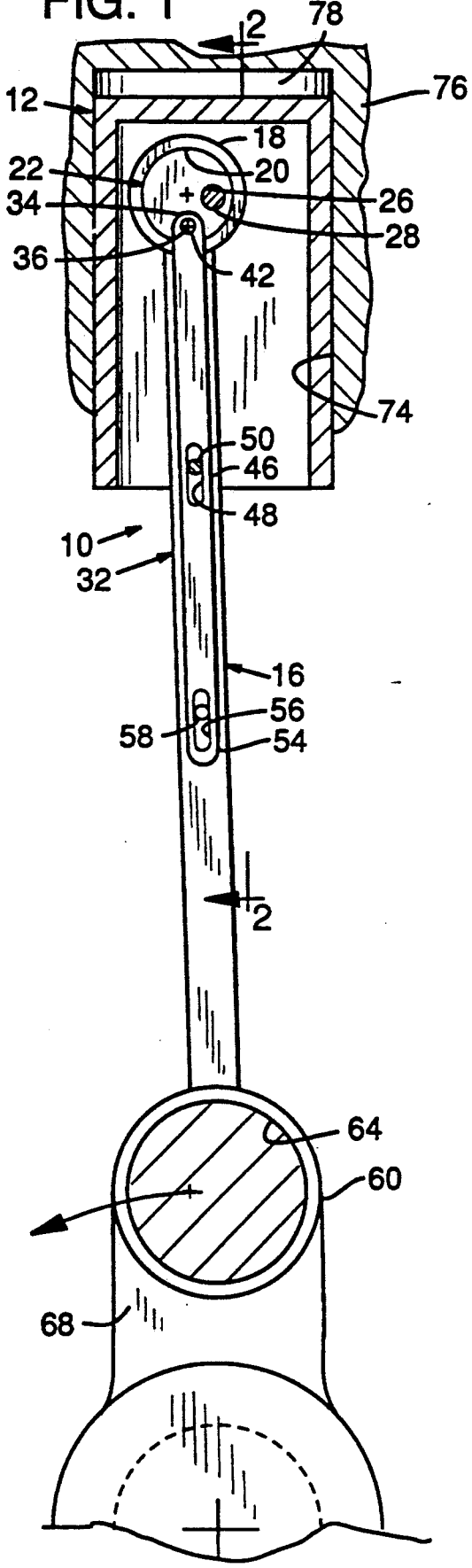
FIG. 1 is a sectional side view of a piston and connecting rod according to the present invention.

FIG. 1 shows a connecting rod assembly 10 for connecting a crank shaft 68 and a conventional piston 12 arranged to reciprocate in a cylinder 74 defined in a conventional two-stroke or four-stroke internal combustion engine 76. Alternatively, the assembly may be employed in a compressor, pump, refrigeration device or the like, using similar mechanisms. In some such alternative applications, such as a fuel injector, the disclosed apparatus may be modified to produce a reduced dwell for a pumping impulse instead of a pause at top dead center.

The connecting rod assembly includes a unitary forged connecting rod 16 having an upper end 18 defining a cylindrical sleeve 20. A cylindrical disc 22 is closely and rotatably received within the sleeve 20. The disc defines a wrist pin bore 26 offset from and parallel to the axis of the disc, passing entirely through the disc to closely and rotatably receive a wrist pin 28, which is rigidly mounted within the piston, as shown in FIG. 2.

Figure 2:
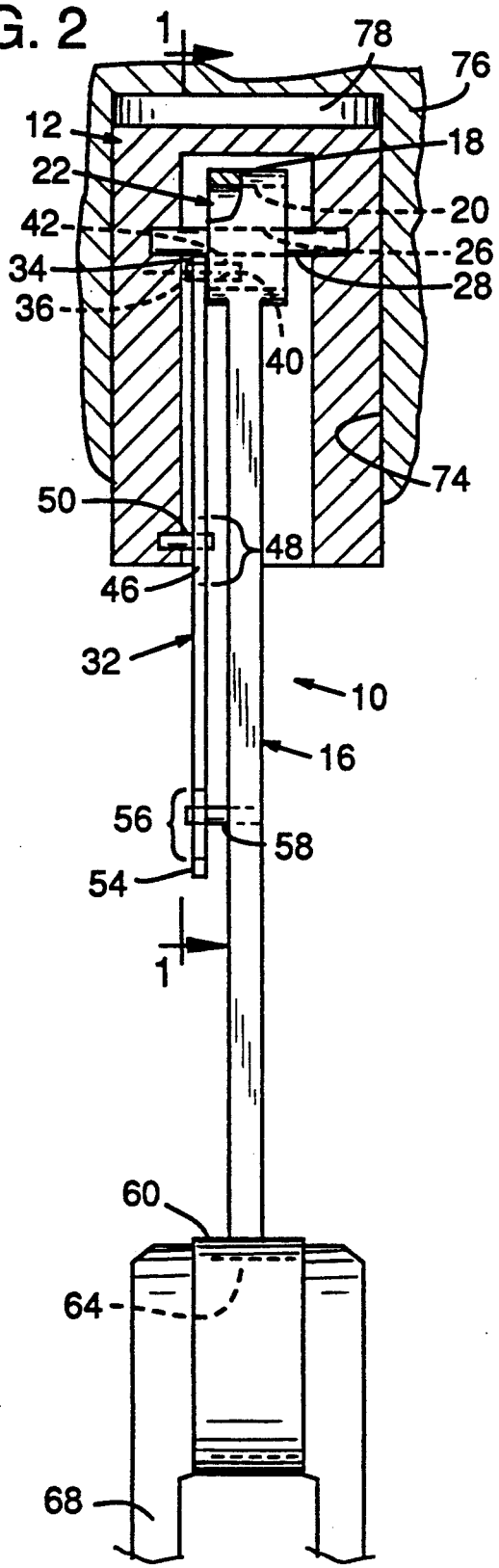
FIG. 2 is a sectional side view of the apparatus of FIG. 1 taken along line 2—2.

As further shown in FIG. 2, a rigid, elongated shifter bar 32 is pivotally mounted at an upper end 34 to an eccentric point 36 on the disc 22. The eccentric point 36 is the axial center of an eccentric bore 40 defined in the disc 22 at a position offset from the center of the disc and angularly offset about the center of the disc from the wrist pin bore 26. The angular offset may be of any value, with 0 degrees providing a mildly increased dwell centered at TDC, 90 degrees providing substantial dwell after TDC, 180 degrees providing mildly decreased dwell at TDC, and 270 degrees providing dwell before TDC, with intermediate values providing intermediate results. In the preferred embodiment, 80 degrees has been selected to provide the desired dwell after TDC. When a mild dwell is desired, the shifter bar may be attached directly to the wrist pin to provide a 0 degree offset angle.

The shifter bar 32 includes a disc shifter pin 42 sized to be rotatably received in the eccentric bore 40. At an intermediate position 46 on the shifter bar 32, the shifter bar defines an elongated piston pin slot 48. The piston pin slot 48 is centrally aligned along the length of the shifter bar 42 and is sized to slidably receive a piston pin 50 that protrudes inwardly from the interior of the piston 12. The piston pin 50 is oriented on an axis parallel to the wrist pin 28 at a position well below the wrist pin and slightly laterally offset therefrom.

The shifter bar 32 includes a lower end 54 defining a lower slot 56 configured similarly to the piston pin slot 48 and sized to slidably engage a rod pin 58 fixed to and protruding from the connecting rod 16 at an intermediate position thereon. The connecting rod 16 defines at its lower end 60 a crank sleeve 64 sized to rotatably receive an orbiting portion of the crank 68.

EXAMPLE

In a preferred embodiment engine, the piston has a diameter of 80 mm and a stroke of 137 mm. The stroke corresponds to the diameter of the circle traced by the center of the orbiting crank portion within the crank sleeve 64. The illustrated embodiment is optimized for operation at 9,000 rpm, providing a dwell time of substantially constant volume combustion for approximately 15 degrees after top dead center, in a two-stroke engine using gasoline. This dwell angle may be any amount up to about 20 degrees, depending on fuel, speed, and application. As illustrated, the wrist pin 28 has a diameter of 5 mm and the disc shifter pin 42, the piston pin 50 and the rod pin 58 are each 4 mm in diameter. The disc 22 has a diameter of 1 inch, with the center of the wrist pin bore 26 being offset from the center of the disc by 7 mm. The eccentric bore 40 is similarly offset from the center of the disc by 7 mm and is angularly offset from the wrist pin bore 26 by 80 degrees in a clockwise direction. The piston pin 50 is vertically offset below the wrist pin 28 by 2.854 inches and laterally offset by 7 mm, an amount corresponding to the eccentric offset of the wrist pin bore 26. The rod pin 58 is spaced below the center of the disc by 5½ inches, or half the 11 inch overall center-to-center length of the connecting rod 16. Positioning the rod pin substantially below this location may cause interference with a conventional crank shaft when the piston is at bottom dead center. The sleeve 64 has a diameter of 2 inches. The shifter bar has a thickness of 3/16 inches and a width of ½ inch, with the slots 48 and 56 being sufficiently elongated to accommodate the relative motion of the components.

To provide optimization for various fuels, engine sizes and speeds, numerous dimensions may be adjusted to control the angular period during which the piston dwells after top dead center. To increase the dwell time, any number of changes may be made: the disc shifter pin 42 may be moved closer to the center of the disc, the wrist pin bore 26 may be offset farther from the center of the disc 22, the rod pin 58 may be moved upward toward the disc, the piston pin 50 may be moved downward away from the disc, and the angular offset between the wrist pin bore 26 and the eccentric bore 40 may approach 90 degrees. The dwell angle may be reduced by making the corresponding opposite adjustments. Note, however, that for a given stroke or crank orbit diameter, the eccentric point 36 must be adequately offset in the disc 22 to allow the disc shifter pin 42 on the shifter bar 32 to sweep through its full range of motion as the lower end 60 of the connecting rod 16 makes a complete orbit. Where the eccentric point is inadequately offset, the crank orbit diameter must be suitably reduced.

Figure 3:
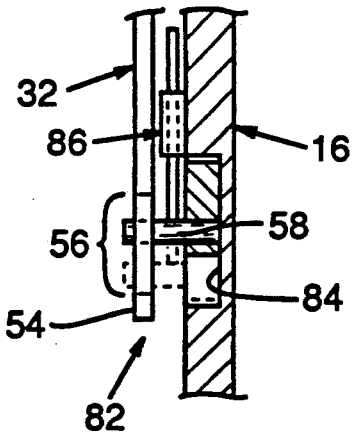
FIG. 3 is a fragmentary sectional side view of an alternative embodiment of the apparatus of FIG. 1 showing a pin adjustment mechanism.

In an alternative embodiment shown in FIG. 3, a compensator may be provided to adjust the piston dwell period while the engine is operating. This adjustment will compensate for variations in engine speed or fuel combustion properties. In this embodiment, the rod pin 58, or alternatively the piston pin 50, or any other geometrically critical component may be adjusted selectably to optimize the engine for alternative fuels and speeds. An adjustment mechanism 82 includes a vertically adjustable rod pin 58 that slides in a groove 84 defined in the connecting rod 16. A remotely controlled solenoid 86 or other linear actuator is connected to the pin 58 to adjust its position. This provides the advantage of optimizing the piston motion profile and dwell period during operation of the engine. Thus, the pin may be shifted to an optimal position as a function of engine speed. The slidable pin may be controlled over a continuously variable range of positions or may be toggled between two separate positions, each suitable for a range of operating conditions. The toggle mode may also be used to convert an engine to an alternative fuel having different combustion characteristics.

In another alternative embodiment, a sensor may detect the properties of an unknown fuel mixture so that a controller may adjust the appropriate position of the shiftable pin. Similarly, other sensors such as exhaust gas analyzers and temperature sensors may detect evidence in the exhaust gas of incomplete combustion, permitting the controller to adjust the dwell time, thereby optimally tuning the engine as it operates.

OPERATION

Figure 4:
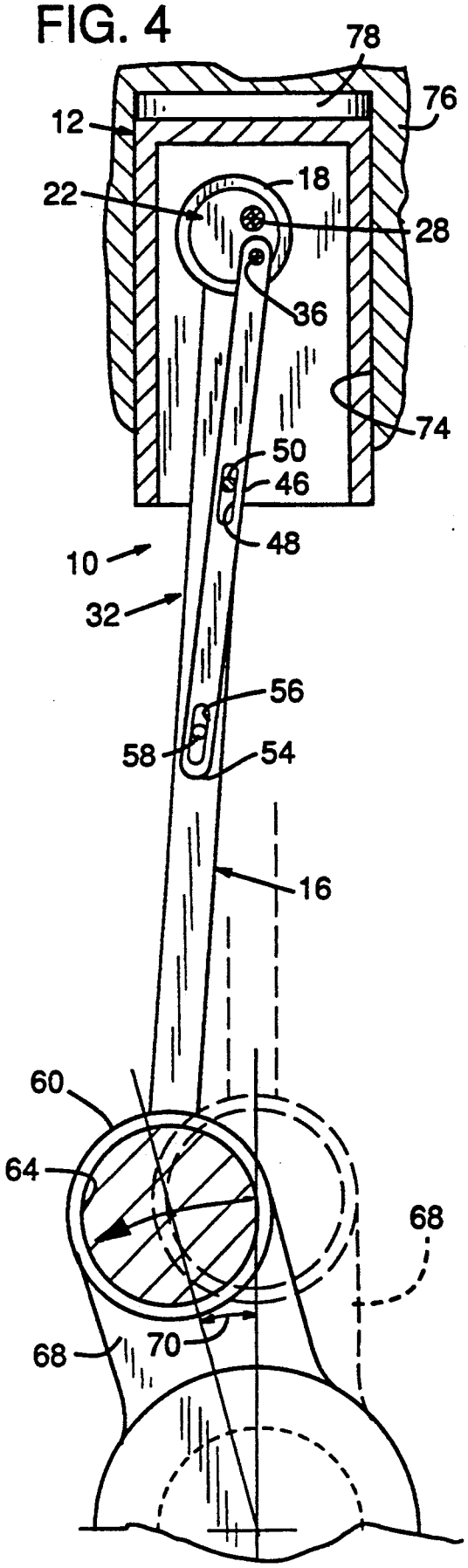
FIG. 4 is a sectional side view of the apparatus of FIG. 1 with the crank rotated partially past top dead center.

FIG. 4 illustrates the operation of the connecting rod assembly 10 as a crank arm 68 attached to the crank sleeve 64 rotates through an initial crank angle 70 illustrated as 15 degrees past top dead center. For comparison, FIG. 1 shows the assembly at top dead center. The piston 12 is shown in a cylinder 74 defined in an engine block 76. A combustion chamber 78 defined within the cylinder 74 by the upper face of the piston remains at substantially constant volume between the top dead center position shown in FIG. 1 and the position shown in FIG. 4.

As further shown in FIG. 4, the generally leftward motion of the lower end 60 of the connecting rod 16 causes the lower end of the shifter bar 32 to move leftward at the rod pin 58. Because the piston pin 50 is fixed to the piston 12 and does not move laterally, it provides a fulcrum about which the shifter bar pivots. Consequently, the upper end 34 of the shifter bar 32 moves to the right, with this rightward motion being accommodated by a counterclockwise rotation of the disc 22. This counterclockwise rotation initially causes the wrist pin 28 to move upward relative to the connecting rod 16. Because the connecting rod is drawn generally downward by the rotation of the crank arm 68, this upward motion of the wrist pin 28 effectively cancels the downward motion so that the wrist pin and piston remain essentially stationary while the connecting rod moves downward. With the effective length of the connecting rod being the center-to-center distance between the wrist pin bore 26 and the crank sleeve 64, the effective length is adjusted to provide the desired constant volume combustion.

Having illustrated and described the principles of my invention with reference to a preferred embodiment, it should be apparent to those skilled in the art that the embodiment may be modified without departing from such principles. For instance, the invention may be employed in two-stroke or four-stroke or other engines employing any of a wide variety of fuels, or may be employed in any reciprocating piston machine such as a compressor or pump. I claim as my invention all such modifications as come within the true spirit and scope of the following claims.

I claim:

1. A connecting rod assembly for connecting a crankshaft and a piston, comprising:

a first end portion operably connected to the crankshaft, a second end portion operably connected to the piston, the second end portion defining a sleeve, a disk rotatably received in the sleeve, the disk defining an eccentric bore for receiving a portion of the piston such that the rod may pivot on the axis of the bore with respect to the piston, and a disc shifter operably connected to the disk for rotating the disk such that the disc rotates in conjunction with pivoting between the rod and the piston.

2. The connecting rod assembly of claim 1 wherein the disk shifter is operably connected to the rod and the piston.

3. The connecting rod assembly of claim 1 wherein the disk shifter interacts with the disk at an eccentric point on the disk.

4. The connecting rod assembly of claim 3 wherein the eccentric point is angularly offset about the center of the disk from the center of the eccentric bore.

5. The connecting rod assembly of claim 4 wherein the angular offset is between 0 and 180 degrees.

6. The connecting rod assembly of claim 1 wherein the disk shifter comprises a rigid elongated member having a first end operably connected with the disk, a second portion operably connected to the piston, and a third portion operably connected to the connecting rod.

7. The connecting rod assembly of claim 6 wherein the shifter first end is pivotally attached to the disk, the second portion is slidably connected to the piston, and the third portion is slidably connected to the connecting rod.

8. The connecting rod assembly of claim 6 wherein the second portion is intermediate the first end and the third portion.

9. The connecting rod assembly of claim 6 wherein the second portion of the shifter is slidably and pivotally connected to the piston.

10. The connecting rod assembly of claim 6 wherein the third portion of the shifter is slidably and pivotally connected to an intermediate portion of the connecting rod.

11. A method of operating a piston attached to a crankshaft by a connecting rod comprising the steps:

rotating the crankshaft, cyclically with rotation of the crankshaft sliding the piston between a top position remote from the crankshaft and a bottom position proximate the crankshaft, and cyclically with rotation of the crankshaft adjusting the effective length of the connecting rod such that the piston remains substantially motionless during a variable portion of crankshaft rotation.

12. The method of claim 11 wherein the piston is held substantially motionless when the piston is near the top position.

13. The method of claim 11 wherein the piston is held substantially motionless during between 4 and 20 degrees of crankshaft rotation.

14. The method of claim 11 wherein the connecting rod includes a first rod end having a rotatable disk having an eccentric attachment point, and a second rod end opposite the first rod end, and wherein the step of adjusting the effective length comprises rotating the disk such that the eccentric attachment point is variably spaced apart from the second rod end.

15. A reciprocating piston apparatus comprising:

a piston, a crankshaft, and an adjustable connecting rod operably connected at a first end connection to a first portion of the piston, and at a second end connection to the crankshaft, the distance between the first and second end connections being cyclically adjustable with rotation of the crankshaft such that the piston remains substantially stationary during an adjustable period of crankshaft rotation.

16. The apparatus of claim 15 wherein the connecting rod first end includes a sleeve for receiving a disk defining an eccentric bore forming the first end connection, such that rotating the disk adjusts the distance between the first and second end connections.

17. The apparatus of claim 15 wherein the connecting rod is operably connected at a third connection to a portion of the piston.

18. The apparatus of claim 17 wherein at least one of the first end connection, the second end connection and the third connection is selectably movable to adjust the period of crankshaft rotation during which the piston remains substantially stationary.

19. The apparatus of claim 18 including a controller operably connected to the selectably movable connection to adjust the movable connection as a function of crankshaft rotation.

20. The apparatus of claim 18 including a selector for selecting between at least two positions of the movable connection to accommodate different fuels having different combustion properties.

21. A multiple-fuel engine suitable for burning fuels having different combustion properties comprising:

a cylinder, a piston defining with the cylinder a chamber, a rotatable crankshaft, a connecting rod operably connecting the piston to the crankshaft, an adjusting mechanism for cyclically with rotation of the crankshaft adjusting the effective length of the connecting rod to maintain the chamber at a substantially constant volume during a period of crankshaft rotation, and a fuel compensator operably connected with the adjusting mechanism for selectably changing the period of crankshaft rotation during which the chamber is maintained at a substantially constant volume.

22. The engine of claim 21 wherein the adjusting mechanism includes a shifter bar operably connected to the connecting rod and piston at connection points, and wherein the compensator comprises an actuator to move at least one of the connection points.

23. The engine of claim 22 wherein the compensator comprises a solenoid.

24. A reciprocating piston apparatus comprising:

a piston, a crankshaft, a connecting rod operably connected at a first end connection to a first portion of the piston, and at a second end connection to the crankshaft, and adjustment means for cyclically adjusting the distance between the first and second end connections of the connecting rod with rotation of the crankshaft, such that the piston remains substantially stationary during an adjustable period of crankshaft rotation.

25. The apparatus of claim 24 including compensator means operably connected to the adjustment means for changing the cyclical adjustment.

* * * * *